United States Patent [19]

Lerch

[11] Patent Number: 4,528,903

[45] Date of Patent: Jul. 16, 1985

[54] RETRACTABLE WHEEL ASSEMBLY FOR MOVABLE BOLSTERS

[75] Inventor: Orville L. Lerch, Chicago, Ill.

[73] Assignee: U.S. Industries, Inc., Stamford, Conn.

[21] Appl. No.: 558,038

[22] Filed: Dec. 5, 1983

[51] Int. Cl.[3] ..... B30B 15/06

[52] U.S. Cl. ..... 100/229 R; 100/918; 72/446; 105/177

[58] Field of Search ..... 72/446, 448, 481; 105/177; 100/918, 221, 224, 229 R

[56] References Cited

U.S. PATENT DOCUMENTS

| | | | |
|---|---|---|---|
| 3,306,185 | 2/1967 | Soman | 100/918 X |
| 3,593,859 | 7/1971 | Spannlang | 105/177 X |
| 3,738,284 | 6/1973 | Atsuta | 105/177 |
| 3,845,718 | 11/1974 | Rogers | 105/177 X |
| 4,433,620 | 2/1984 | Kiyosawa | 100/918 X |
| 4,444,039 | 4/1984 | Assari | 72/448 X |

FOREIGN PATENT DOCUMENTS

| | | | |
|---|---|---|---|
| 785524 | 5/1968 | Canada | 105/177 |
| 0007834 | 3/1972 | Japan | 100/918 |

*Primary Examiner*—Billy J. Wilhite

*Attorney, Agent, or Firm*—Emrich & Dithmar

[57] ABSTRACT

A wheel assembly for movable bolster assemblies adapted to ride on bolster track includes a piston housing vertically oriented above the track. A cylinder piston including a wheel clevis is received within the piston housing. A wheel is rotatably mounted to the clevis and powered by hydraulic pressure to raise or lower the bolster assembly. The cylinder piston is rotatable within the piston housing to allow the axial alignment of the wheel to be changed for orthogonal travel.

28 Claims, 10 Drawing Figures

22
23
30
128
134
38
56
136
67
48
66
138
39
34
32
36

148
30B
150
142

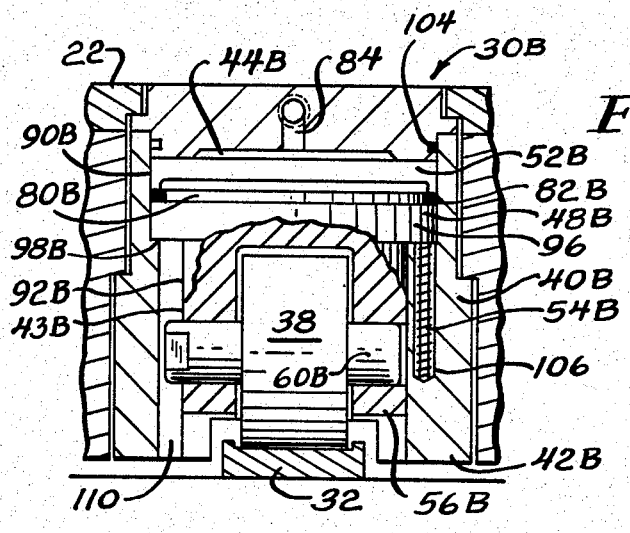
FIG. 6
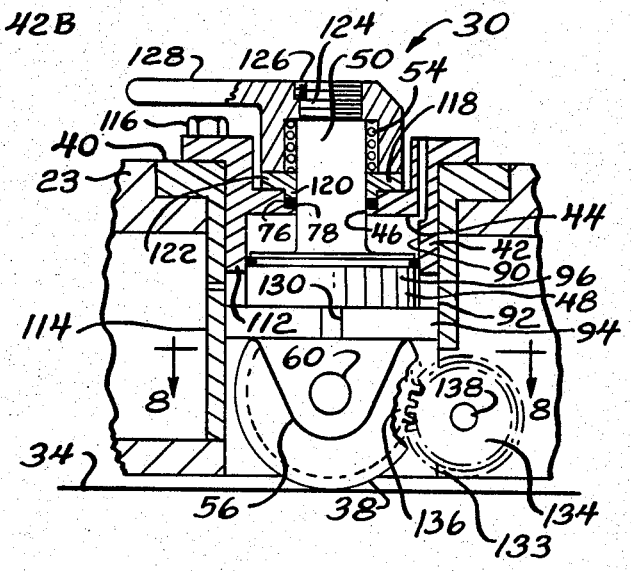
FIG. 7
FIG. 8
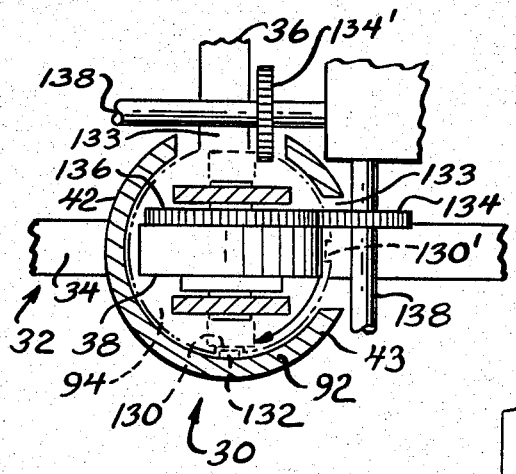
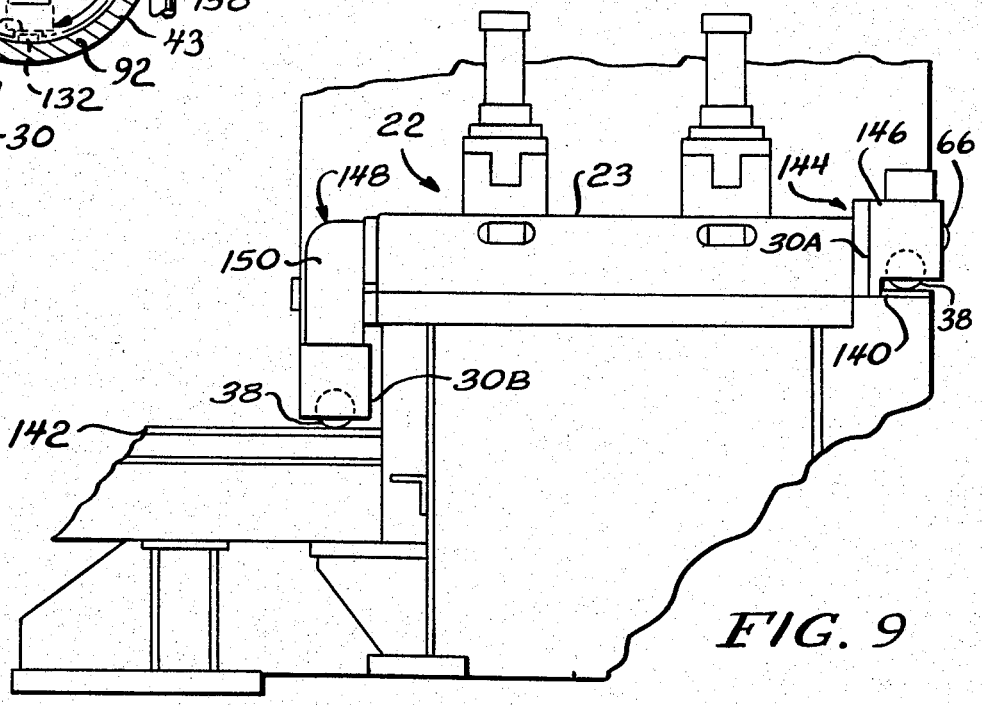
FIG. 9

RETRACTABLE WHEEL ASSEMBLY FOR MOVABLE BOLSTERS

BACKGROUND OF THE INVENTION

This invention relates in general to movable bolsters/carriages for metal working presses, and more particularly to a retractable wheel assembly for movable bolsters/carriages which provides the bolster/carriage with greater flexibility in directional movement.

A metal working press is a heavy type of machine designed to receive, press and shape metal to the contours of a die. The die used to work the metal generally have weights of 25–150 tons, and for certain applications can be even heavier. A bolster is a plate attached to the top of a press bed or carried upon a movable carriage. A carriage is an open box of welded steel construction carried upon carriage wheels, upon which a bolster and/or die is attached. The term bolster/carriage is used in the present application to mean a bolster and/or carriage in combination or separately. The bolster/carriage is generally powered by a reversible pneumatic motor or the like, coupled through reduction gears to a pair of carriage wheels. The bolster/carriage is utilized to carry the die between a loading area and a press structure on a system of tracks. The tracks are generally constructed of heavy, machined I-beams capped with replaceable rail strips. When the bolster/-carriage is positioned in a die area, rail sections beneath the wheels retract, setting the bolster/carriage firmly on the press bed. The bolster/carriage is then securely clamped in place with automatic clamps to provide a firm, stable platform for the bottom half of the die. The upper half of the die is affixed to the press for movement against the bottom half of the die.

Earlier bolster/carriages were capable of carrying dies along a linear track layout from a loading zone to the press site. However, present day production demands and space requirements have encouraged the use of bolsters/carriages and track layouts which are more flexible. Many track layouts now mandate use of bolsters/carriages capable of travel upon orthogonally aligned intersecting tracks.

In order to accommodate orthogonal travel, present bolster/carriages are equipped with one set of four wheels engageable with one set of tracks, and a second set of four wheels, aligned at 90° angles with respect to the first set of wheels, engageable with a second set of orthogonally aligned tracks. One set of orthogonal wheels is actuated hydraulically through a system of hydraulic cylinders and levers to engage its associated tracks, while the other set is raised to a disengaged position relative to its associated track.

In order to change from a simple in line track layout to the more orthogonal complex track layout just described, not only does the track system need to be changed but the entire bolster/carriage system has to be replaced at considerable expense. Further, the necessity of the bolster/carriages having two sets of four wheels with only one set being used at any one time is deemed to be unnecessary duplication and add to the cost of manufacture.

SUMMARY OF THE INVENTION

The present invention greatly simplifies bolster/carriage construction and press operations by providing a bolster/carriage wheel assembly capable of moving a bolster/carriage in orthogonal directions with only one set of wheels. It is also capable of raising and lowering a bolster/carriage onto a press bed, and it is readily adaptable to retrofit existing in-line equipment. The present invention simplifies bolster/carriage equipment through the elimination of expensive mechanical components.

Briefly, an embodiment of the present invention includes a retractable wheel assembly for movable bolsters adapted to ride on bolster tracks. The wheel assembly includes a housing having a cylinder adapted to be affixed to a bolster/carriage assembly above bolster tracks. The cylinder is substantially open towards one end for positioning proximal to the track and includes an end wall towards the opposite end for positioning distal to the track. A cylinder piston is slideably received within the cylinder capable of assuming a lowered extended position and a raised withdrawn position. The cylinder piston includes a clevis projecting downward toward the open end of the cylinder. A bolster wheel is rotatably affixed to the clevis of the cylinder piston in an orientation for engagement with the bolster track. A hydraulic fluid line, in communication with the chamber, receives hydraulic fluid and allows the chamber to be pressurized to power the cylinder piston to the first extended lowered position where the bolster/carriage wheel may engage the bolster track and cause the wheel assembly to lift the bolster/carriage. The hydraulic fluid line also allows the hydraulic fluid to be carried away from the chamber, depressurizing the chamber and permitting the piston to assume a second raised vertical position to allow the bolster/carriage wheel to disengage the track.

An embodiment of the present invention further includes a wheel assembly wherein the clevis of the cylinder piston is rotatable within the cylinder housing to allow the bolster/carriage wheel to assume various directional or axial orientations about a horizontal plane. A turning lever and a lock device facilitate turning the bolster/carriage wheels into proper orientation with the track and locking the bolster wheels in alignment.

A further embodiment of the present invention includes a retractable wheel assembly wherein the bolster/carriage wheel includes a driven gear affixed to the bolster/carriage wheel in side-by-side relationship and selectively engageable with either a first or a second drive gear coupled to a power source. The bolster/carriage wheel is rotatable about a horizontal plane between a first rotational position where the driven gear is engageable with the first drive gear and a second rotational position wherein the driven gear is engageable with the second drive gear to allow the wheel assembly to move the bolster/carriage in different directions.

The retractable wheel assembly of the present invention can be retrofitted to existing bolsters by means of a housing which attaches to a sub-frame which is bolted onto the bolster. Further, the present invention, capable of raising and lowering the bolster and does not rely upon retracting track to lower the bolster onto a press bed.

Other features and advantages of the present invention will be apparent from the following description and claims and are illustrated in the accompanying drawings which, by way of illustration show preferred embodiments of the present invention and the principles thereof and what are now considered to be the best mode to apply these principles. Others embodiments of the invention employing the same or equivalent principles may be used and structural changes may be made as desired by those skilled in the art without departing from the present invention and the purview of the appended claims.

BRIEF DESCRIPTION OF THE DRAWINGS

FIG. 6 is an enlarged sectional view of a bolster/carriage wheel embodying principles of the present invention;

FIG. 7 is an enlarged detailed sectional view of the wheel assembly of FIG. 1 embodying principles of the present invention;

FIG. 8 is a sectional view taken substantially along line 9—9 of FIG. 7.

FIG. 9 is a side perspective view of a bolster retrofitted with bolster wheel assemblies embodying principles of the present invention;

DETAILED DESCRIPTION OF THE DRAWINGS

The present invention will be described in detail as a movable bolster/carriage and retractable wheel assemblies for movable bolsters/carriages with the understanding that the present disclosure is to be considered an exemplification of the principles of the invention and is not intended to limit embodiments of the invention to those illustrated.

Figures 1, 10:
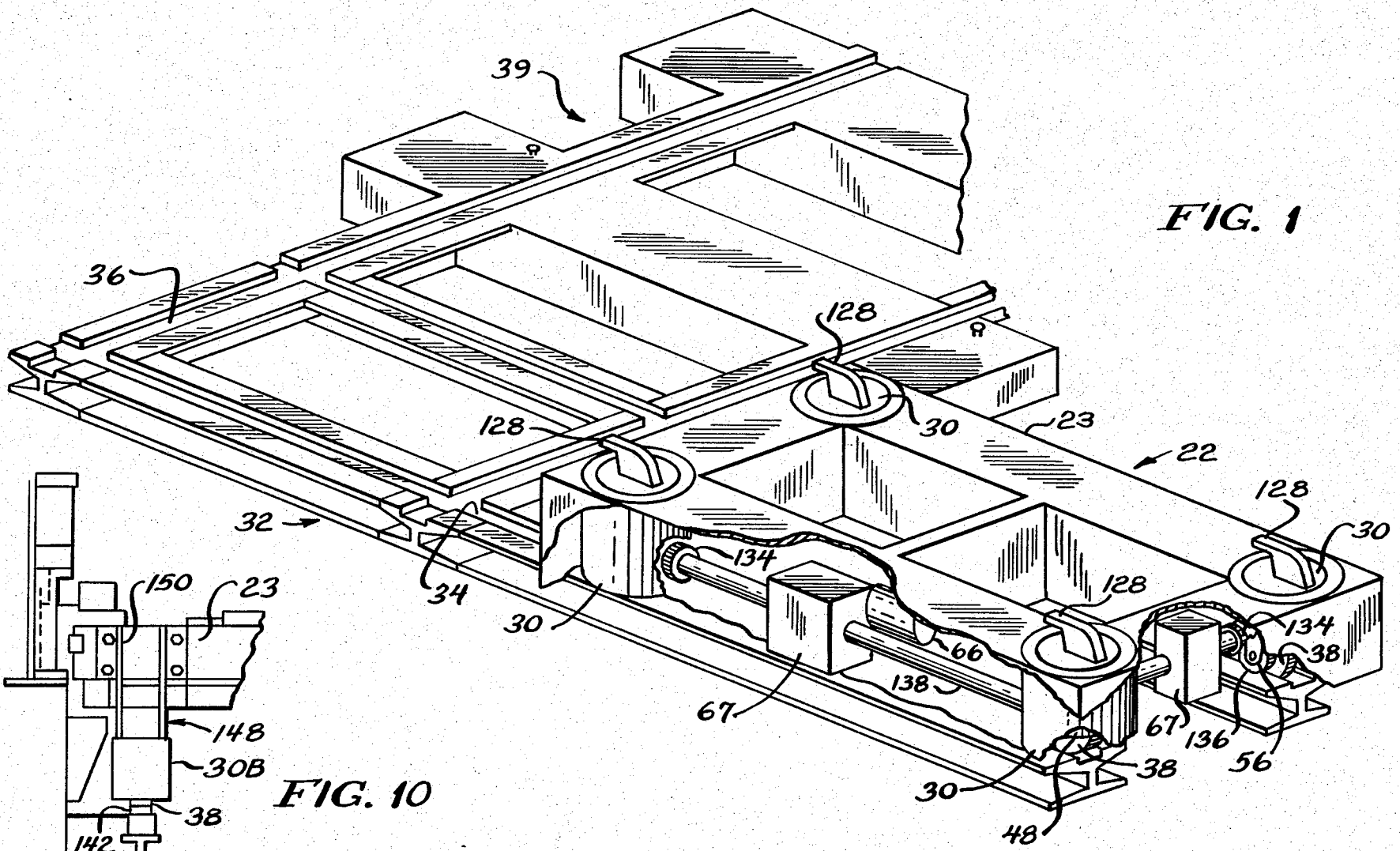
FIG. 1 is a perspective sectional view of a movable bolster/carriage and track layout embodying principles of the present invention.
FIG. 10 is a front sectional view of the bolster of FIG. 9 retrofitted with bolster wheel assemblies embodying principles of the present invention.

Referring now to FIG. 1, the movable bolster/carriage of the subject invention, generally designated by numeral 22 is comprised of two major components: a solid plate or welded frame 23 and four wheel assemblies 30. Frame 23 provides a strong stable support for the movement of dies (not shown) carried on the upper surface. Each of the wheel assemblies 30 includes a bolster wheel 38 which rides on a system of rails 32 defining tracks 34 extending substantially laterally across the field of vision in the foreground and tracks 36 extending fore-and-aft towards the rear. The movable bolster/carriage 22 is shown on track 34 in a loading position for receiving a die assembly to be positioned on the bolster/carriage 22 by suitable means such as an overhead crane (not shown). After loaded, the bolster/-carriage 22 moves laterally towards intersecting tracks 36. After reaching the intersection of fore-and-aft track 36, the bolster/carriage carries its load down track 36 towards press bed 39 where the bolster/carriage 22 is received. The majority of the press assembly has been deleted from the drawings for the purposes of clarity. Wheel assembly 30 is capable of travel upon the orthogonally arranged tracks 34 and 36 of rails 32. Wheel assembly 30 will be discussed more fully after an examination of other simpler embodiments.

Figure 2:
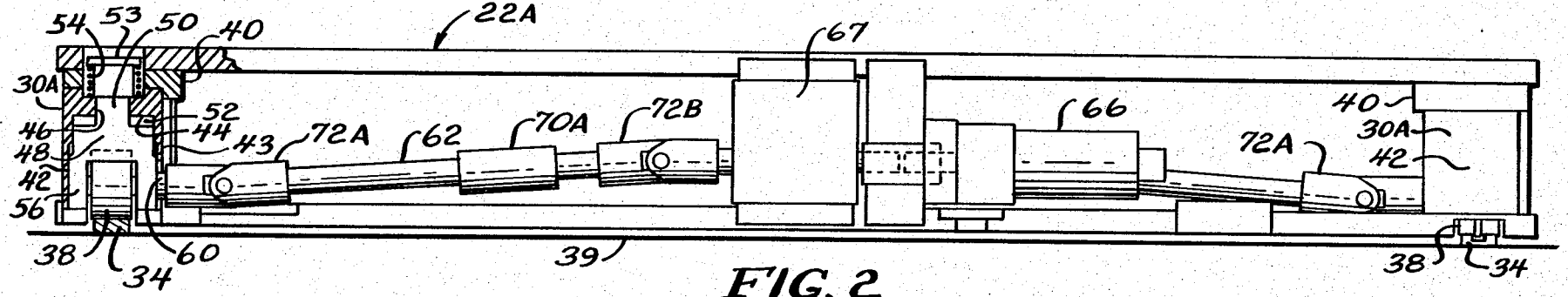
FIGS. 2 and 3 are rear sectional views of bolsters/-carriages showing embodiments of the present invention in which the bolster wheels are respectively lowered and raised.
Figure 3:
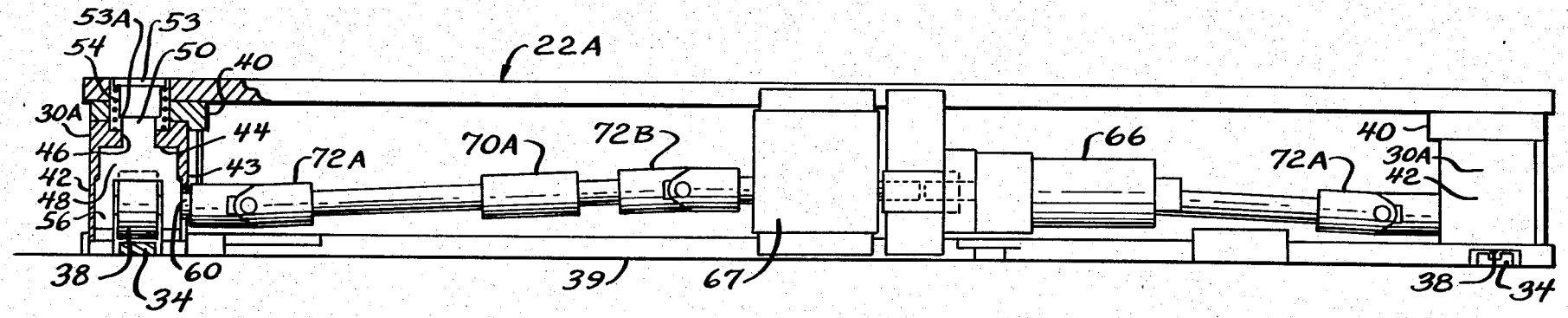

Turning to FIGS. 2 and 3, an alternative bolster/carriage 22A, is shown in a sectional rear view, capable of movement upon linearly arranged track only. Each wheel assembly "designated 30A" is compact and substantially self-contained to allow retrofitting of existing bolsters/carriages 22A. Each wheel assembly 30A of bolster/carriage 22A is positioned above track 34 and includes a housing 40 having a cylindrical portion 42. The cylindrical portion 42 includes cylindrical walls 43 defining an opening at one end positioned proximal to track 34 and having an end wall 44 towards the end positioned distal to track 34. End wall 44 has an opening 46 positioned concentric with the cylinder walls 43.

A piston 48 is slideably received within the cylindrical portion 42 of each cylinder housing 40. Piston 48 includes a piston rod 50 which is slideably received within opening 46 in end wall 44, providing greater stability to the piston 48. The end wall 44, cylindrical wall 43, and piston 48 define a chamber 52 for receiving hydraulic fluid to force the piston 48 to assume two positions, an extended position shown in FIG. 2 in which the bolster/carriage is raised above the tracks and a raised position as shown in FIG. 3 in which the bolster/carriage rests on the tracks.

A cap 53 is secured over rod 50 compressing a coil spring 54 against the upper exterior portion of the housing 40 biasing the piston 48 toward the raised position.

Each piston 48 includes a clevis 56 extending downward towards the track 34. A bolster/carriage wheel 38 is affixed to an axle 60 which is rotatably affixed to clevis 56. The cylindrical walls 43 of each housing 40 extends downward and substantially surrounds clevis 56 and the bolster/carriage wheel 38 to provide greater stability to the clevis 56 and bolster wheel 38.

Axle 60 is keyed to a shaft 62 which is rotated by a pneumatic motor 66 or the like throughout a reduction gearing transmission 67, sliding coupling 70A and universal joints 72A and 72B. Sliding coupling 70A and universal joints 72A and 72B allow the shaft 62 to assume various effective lengths and angular relationships as the bolster wheel 38 is raised or lowered.

FIG. 2 depicts bolster/carriage 22A in a traveling mode with bolster/carriage wheels 38 extended downward lifting the carriage 22A free of track 34 and press bed 39. Interior chamber 52 is pressurized with hydraulic fluid exerting a downward force on piston 48 and engaging bolster/carriage wheels 38 with track 34.

FIG. 3 depicts bolster/carriage 22A positioned upon a press bed 39 in a stationary mode for performing press operations. Bolster/carriage wheels 38 are raised by depressurizing interior chamber 52 and allowing spring 54 to retract the piston 48 thereby disengaging bolster/-carriage wheels 38 from track 34. The amount of movement of the bolster/carriage wheels 38 is sufficient to disengage from the rail strips.

Figure 4:
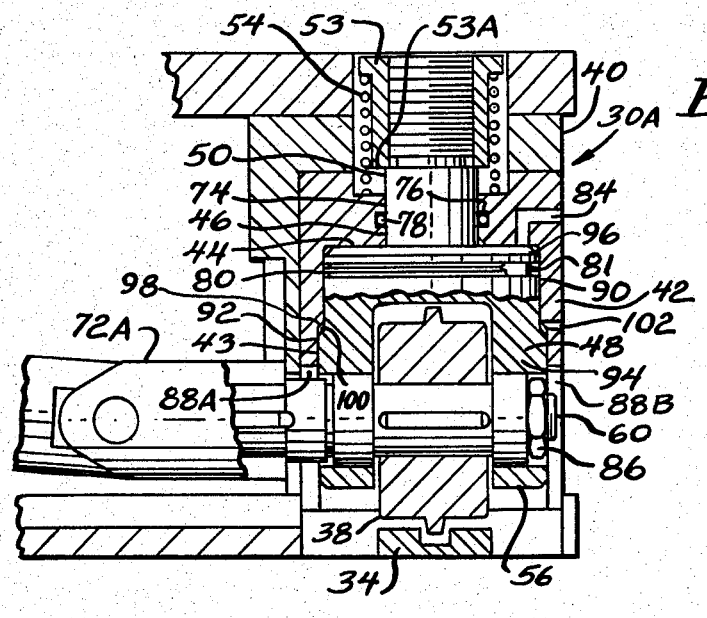
FIGS. 4 and 5 depict detailed side sectional views of a single wheel assembly of FIGS. 2 and 3 showing the wheel assembly in a raised elevated position out of engagement with an underlying track structure and in a lowered extended position engaging an underlying track structure.
Figure 5:
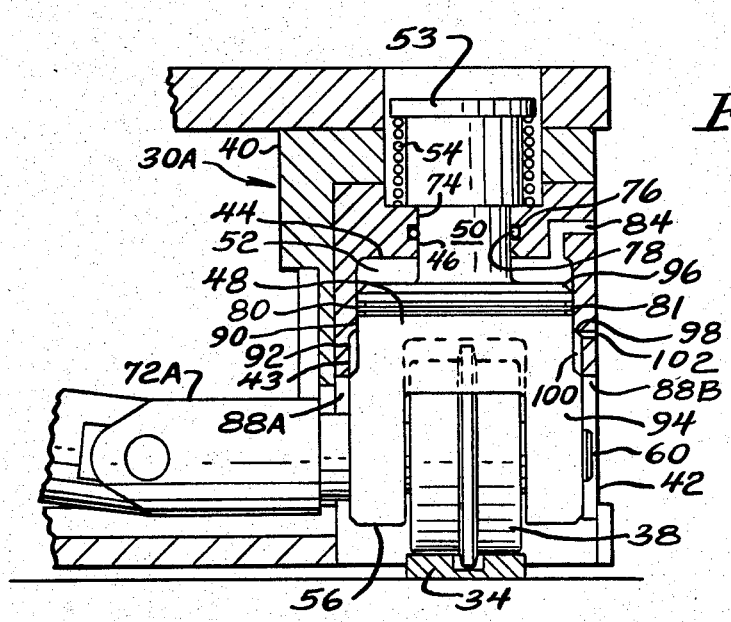

Referring now to FIGS. 4 and 5 where the wheel assembly 30A of FIGS. 2 and 3 is shown in greater detail, the piston 48 is normally biased upward by spring 54 exerting a force on end cap 53 secured to rod 50. End cap 53 includes an internally threaded opening receiving corresponding threads on rod 50. End cap 53 defines a shoulder 53A which provides an end stop for the movement of piston 48 which is best seen in FIG. 5. Piston 48 is extended downward by hydraulic pressure pulling piston rod 50 through end wall opening 46 until end cap 50 impacts upon the upper surface of end wall 44.

The opening 46 in the end wall 44 defines a cylindrical sleeve 74 for snuggly receiving rod 50. Sleeve 74 includes a recess 76 adapted to receive an upper seal 78 which engages the walls of recess 76 and rod 50 to prevent hydraulic fluid from escaping.

Similarly, piston 48 is provided with recesses 80 which receive piston seals 81. Piston seals 81 engage the cylindrical walls 43 of the cylindrical housing 40 also to retain hydraulic fluid within the chamber 52.

Housing 40 also includes a hydraulic line inlet 84 entering chamber 52 through end wall 44 of cylinder 42. Inlet 84 is connected to an outside source of hydraulic fluid for receiving and directing hydraulic fluid into and out of the chamber 52.

Clevis 56 is integrally formed with the piston 48 dimensioned to be retained within the interior of the cylindrical wall 43. Bolster wheel 38 is rotatably affixed to the clevis 56 by means of an axle 60 extending through the clevis and secured at one end by a bolt 86. The other end of the axle 60 is keyed and affixed to universal joint 72A by suitable means such as a second bolt (not shown).

Universal joint 72A extends through a slot 88A in the cylindrical wall 43. Similarly, a portion of the axle 60 opposite universal joint 72 extends through a slot 88B in the opposite side of cylindrical wall 43. Slots 88A and 88B extend vertically along cylindrical wall 43 allowing the axle to slide up and down within the slot as the piston is raised and lowered. Further, slot 88A and 88B maintain bolster wheel 38 in correct linear alignment with the underlying track 34.

Cylindrical wall 43 includes a narrow cylindrical wall section 90 which defines an area for the travel of the piston seals 81, and an expanded cylindrical area 92 accommodates the bolster wheel 58 and axle 60. Piston 40 includes a corresponding interfitting expanded piston section 94 and a narrow piston section 96. Narrow piston section 96 includes the recesses for piston seals 81. The lower expanded piston section 94 distributes lateral forces to the lower expanded cylinder wall 90 to maintain proper alignment of piston seals 81 and the upper narrow cylindrical wall 92.

The expanded cylindrical wall 90 and narrow cylinder wall 92 are separated by a ridge 98. Ridge 98, the expanded cylindrical wall 90, and the narrow piston portion 96 define a secondary chamber 100 which is preferably vented by means of a vent 102 to allow air trapped within the secondary chamber 100 to exit or enter as the piston 40 is raised or lowered.

In operation, referring now to FIGS. 3 and 4, when the bolster wheel assemblies 30A are raised, the bolster/carriage 22A is in a lowered position with the frame 23 resting on press bed 39. Piston 48 is held in a raised position by spring 54 when chamber 52 is depressurized. Spring 54 exerts a force on end cap 53 and piston rod 50 to hold piston 48 in an at-rest position with piston 48 and bolster wheel 38 substantially withdrawn into cylinder 42.

Referring now to FIGS. 2 and 5, when the bolster wheels 38 of the wheel assemblies 30A are lowered, the bolster/carriage 22A is raised with the frame 23 clear of all surface obstructions for travel along track 34. The bolster/carriage 22A is held in a raised position by the pressure of hydraulic fluid within chamber 52 of cylinder 42. Movement of the piston 48 downward withdraws piston rod 50 through opening 46 in the end wall 44 of cylinder 42 causing end cap 53 to compress spring 49. Downward movement of the piston 48 is limited as end cap 53 engages the top surface of end wall 44 of cylinder 42.

Activation of the motor 66 drives the bolster wheels 38 through transmission 67, shafts 62, sliding coupling 70A and universal joints 72A and 72B. Sliding coupling 70A and universal joints 72A and 72B allow the shaft 62 to assume various effective lengths and angular relationships as the bolster wheel 38 assumes a lowered position as shown in FIG. 2 or an elevated position as shown in FIG. 3.

Turning now to FIG. 6, an alternative embodiment of wheel assembly, designated 30B, is illustrated which is capable of operation on linearly arranged tracks. Wheel assembly 30B is nonpowered and is suited for use in conjunction with wheel assemblies 30A just described and are compact and suitable for use in retrofitting existing equipment. The housing 40B includes a cylinder 42B including cylinder wall 43B and end wall 44B. The end wall 44B is secured to the cylinder 42B of the housing 40B by suitable means such as bolts (not shown) and sealed by means of housing seals 104. A spring 54B is nested within a depression 106 extending parallel to cylindrical wall 43B of the housing 40B. Spring 54B is biased against the piston 48B, to raise piston 48B when chamber 52B is depressurized to disengage bolster wheel 38 from track 34.

Piston 48B includes a recess 80B running about its circumference adapted to retain piston seal 82B. Hydraulic fluid is directed into chamber 52B by means inlet 84 located in end wall 44B to pressurize chamber 52B and force piston 48B into a lowered position.

The wheel assembly 30B of FIG. 6 has a cylindrical wall 43B with an upper expanded portion 90B and a lower narrowed portion 92B separated by a ridge 98B. Piston 48 includes an expanded top portion 96 and a clevis 56B. The expanded top portion 96 of piston 48B travels over the upper expanded portion 90B of the cylinder 42B with the ridge 98B forming an end stop to prevent the piston from descending further through the cylindrical housing. Further the ridge 98B provides a firm base for piston 48B to stabilize the piston while the piston 48B is lowered to raise a bolster/carriage 22.

Axle 60B extends laterally beyond the clevis 56 into a retaining groove 110 within the lower narrowed portion 94B of cylindrical wall 43B of the cylinder 42B. Vertical retaining groove 110 receives a portion of the laterally extending axle 60B to maintain the bolster wheel 38 in linear alignment with the track 34.

Axle 60B is not driven. The wheel assemblies 30B of FIG. 6 are well-suited for use as a pair in conjunction with the powered wheel assemblies 30A of FIGS. 4 and 5. Wheel assembly 30B, depicted in FIG. 6, does not differ materially in operation from the previously discussed wheel assembly 30 depicted in FIGS. 2, 3, 4 and 5 with exception of those features of wheel assembly 30A which allow the wheel 38 to be driven.

Referring now to FIGS. 1, 7 and 8, wheel assembly 30, previously introduced, permits rotation of the axial alignment of the bolster wheel 38 for orthogonal travel. Wheel assembly 30 is compact and suitable for retrofitting existing equipment particularly where it may be desired to change from a linear arrangement to one where tracks are arranged orthogonally. Wheel assembly 30 includes a housing 40 having a cylinder portion 42 for receiving a piston 48. The cylinder portion 42 includes a cylindrical wall 43 having an upper narrowed portion 90, an end wall 44, lower expanded portion 92.

The housing 40 is comprised of two major sections, an inner section 112, which includes the narrow portion 90 of cylindrical wall 43 and end wall 44, and an outer section 114 which includes the lower expanded portion 92 of cylindrical wall 43. The outer section 114 of the housing 40 nests upon an opening in bolster frame 23 where it is secured by suitable means such as welding or bolts (not shown). Similarly, inner section 112 nests within outer section 114 of the housing where it is secured by suitable means such as bolts 116 (only one shown).

Piston 48 includes a lower expanded piston portion 94 and a narrow upper piston portion 96 and a piston rod 50. End wall 44 includes an opening 46 for receiving piston rod 50. The exterior surface of end wall 44 includes a recess 76 for receiving a seal 78. A seal cap 118 includes a rim 120, which nests in recess 76 securing seal 78, and an outwardly extending flange 122 which engages spring 54.

End cap 53 is secured to piston rod 50 by means of a corresponding interfitting threads 124 on piston rod 50 and end cap 53. End cap 53 and piston rod 50 further include corresponding keyholes for receiving a pin 126 to allow end cap 53 and piston rod 50 to be rotated in unison. End cap 53 includes a handle 128 to facilitate the rotation of the piston 48 and bolster wheel 38 when the piston 48 and bolster wheel 38 are in a raised position.

Referring now to FIG. 1, it will be recognized by those skilled in the art that handles 128 can be readily substituted with a gearing system to allow all the wheels to be aligned with tracks 34 or intersecting track 36 from a central position aboard the bolster/carriage 22.

Referring now to FIGS. 7 and 8, in a lowered position piston 48 is prevented from rotating by an interfitting vertical groove 130 about the lower expanded portion 92 of piston 48 which is retained within an interfitting protruding vertical tongue 132 positioned about the lower expanded portion 90 of cylinder wall 43. The vertical protruding tongue 132 extends along the cylinder wall 43 of the cylinder 42 to engage vertical groove 130 only when the piston 48 is in a lowered position.

In a raised position, piston 48A and vertical groove 130 are disengaged from vertical tongue 132 to allow the piston 48 to freely rotate within the cylinder 42. Referring to FIG. 8, rotation of the bolster wheel 38, 90°, in the direction indicated by the arrow, allows the wheel to change its axial alignment for movement in an orthogonal direction. Rotation 90° allows a second vertical groove 130' to become aligned with the vertical tongue 132, whereupon lowering of the piston 48 cause vertical tongue 132 and groove 130' to lock the piston into correct alignment with the orthogonal track 36.

The wheel assembly 30 is capable of powered movement by means of drive gears 134 and 134' and driven gear 136. Driven gear 136 is affixed to one side of bolster wheel 38. Driven gear 136 is smaller in diameter than bolster wheel 38 to avoid interference with underlying tracks 34 or 36. Drive gear 134 and 134' are coupled to a powered shaft 138 rotatably affixed to the bolster frame 23. Each drive gear 134 and 134' protrudes through a slotted opening 133 in the cylindrical wall 43 of the cylinder 42 of housing 40. As best seen in FIG. 7, lowering the piston 48 engages driven gear 136 with drive gear 134. In a lowered position, driven gear 136 is held in alignment with drive gear 134 by the engagement of vertical groove 130 and vertical tongue 132. Raising piston 48, disengages vertical groove 130 from vertical tongue 132 and disengages driven gear 136 from drive gear 134 allowing the piston 48 to freely rotate 90° lowering piston 48 engages driven gear 136 with drive gear 134' and vertical groove 130' with vertical tongue 132 for orthogonal movement on track 34.

In operation the bolster/carriage 22 is moved along track 34 to the intersection of track 36. The bolster/carriage 22 is lowered by raising each piston 48 within cylinder 42, disengaging the driven gear 136 from drive gear 134 and disengaging vertical groove 130 of piston 48 from the vertical tongue 132 of cylinder wall 43. The operator rotates each piston 48 by means of handle 128 to align each bolster wheel 38 for movement about track 36. Driven gear 136 of each wheel assembly 30 is engaged with drive gear 134' as piston 48 is powered to lowered position and bolster wheel 38 engages track 36. Upon elevation of the bolster/carriage and realignment of each wheel assembly 30, the bolster/carriage 22 reassumes its travel along track 36 towards the press bed 39.

The self-contained compact nature of the wheel assemblies 30, 30A and 30B readily permit the retrofitting of existing equipment. Referring now to FIGS. 9 and 10, a bolster/carriage 22 is shown retrofitted with wheel assemblies 30 and 30B corresponding to the structures illustrated in FIGS. 4, 5 and 6.

Referring specifically to FIG. 9, powered wheel assemblies 30A, depicted in detail in FIGS. 4 and 5, are shown mounted to the rear of bolster/carriage frame 23 positioned to rest upon elevated tracks 140. Turning now to both FIGS. 9 and 10, wheel assembly 30B, illustrated in detail in FIG. 6, is shown mounted to the front of bolster/carriage frame 23 positioned to ride upon a set of lower tracks 142.

Rear bolster wheel assemblies 30A, shafts 62, motor 66, and transmission 67 are incorporated into a powered bolster wheel unit 144 having a frame 146 which is bolted or otherwise affixed to the rear of bolster/carriage frame 23. The bolster wheel assembly 30B is incorporated into an elongated bolster wheel unit 148, affixed to the front of bolster/carriage frame 23, having an elongated frame 150 which is bolted to or otherwise affixed to a bolster/carriage frame 23.

It will be seen that the present invention provides a compact bolster wheel unit capable of numerous applications to provide flexibility in the retrofitting of equipment often necessitated by a rearrangement of the track systems for more efficient operation of production facilities. It will also be seen that the present invention affords a bolster wheel assembly which is both practical and efficient in operation and can be readily and economically produced and operated.

Thus, while the preferred embodiments of the present invention have been illustrated and described, it is to be understood that these are capable of variations and modifications, and the present invention should not be limited to the precise details set forth, but should include such changes and alterations that fall within the purview of the following claims:

I claim:

1. A wheel assembly for movable bolster assemblies adapted to ride on bolster track comprising:

a housing adapted to be affixed to a bolster assembly, said housing having a cylinder portion open towards one end for positioning proximal to the bolster track;

cylinder piston means slidably received within said cylinder portion of said housing for movement along a generally vertical axis between first and second positions, said cylinder piston means and cylinder portion defining a chamber for receiving hydraulic fluid, said cylinder piston means including wheel mounting means;

bolster wheel means rotatably affixed to said wheel mounting means of said cylinder piston means for movement with said cylinder piston means along said axis into and out of engagement with said bolster track as said cylinder piston means is moved between said first and second positions; and, hydraulic fluid line means in communication with said chamber for receiving hydraulic fluid to power said cylinder piston means and wheel means between said first position wherein said wheel means is engaged with said track and said second position wherein said wheel means is disengaged from said track, to raise and lower a bolster.

2. The assembly of claim 1 further including spring means coupled to said piston means and said housing biasing said cylinder piston means in one of said positions to facilitate movement of said wheel means.

3. The wheel assembly of claim 1 wherein said cylinder portion includes an end wall and a cylindrical wall, said end wall includes an opening and said cylinder piston means further includes a vertically projecting rod extending through and slidably received by said opening in said end wall to provide stability to said cylinder piston means.

4. The wheel assembly of claim 3 further including spring means affixed to said rod for engagement with said end wall to bias said cylinder piston means in one of said positions to facilitate movement of said wheel means.

5. The wheel assembly of claim 3 wherein said rod further includes an end stop means restricting the travel of said piston means as said piston means travels outward from said cylinder portion.

6. The wheel assembly of claim 1 wherein said cylinder portion includes a cylinder wall which includes an upper narrow portion and a bottom expanded portion separated by a ridge; and said cylinder piston means includes an upper narrow portion and a lower expanded portion separated by a piston ridge adapted to be received in corresponding respective portions of said cylinder wall, said upper narrow portion of said piston means includes seal means in said lower expanded portion of said piston means enageable with said cylinder wall of said expanded portion to stabilize said piston means.

7. The wheel assembly of claim 6 wherein said cylinder portion includes a ridge, expanded portion of said cylinder wall which, said piston ridge, and said narrow portion of said piston define a secondary chamber, said housing means further comprised vent means allowing gases to communicate with said secondary chamber.

8. The wheel assembly of claim 1 wherein said cylinder portion includes a cylinder wall which includes an expanded upper portion and a narrow lower portion separated by a ridge, said cylinder piston means slideably received within said expanded upper portion in sealing engagement with said expanded upper portion walls, said ridge engageable with said cylinder piston means as said cylinder piston means is powered to one of said positions forming an end stop for the travel of said cylinder piston means.

9. The wheel assembly of claim 8 further comprising spring means and said ridge includes cavities for receiving said spring means, said spring means coupled to said cylinder piston means biasing said cylinder piston means in one of said positions to facilitate movement of said wheel means.

10. The wheel assembly of claim 1 further comprising a wheel assembly frame secured to said housing adapted to be affixed to a bolster assembly.

11. A wheel assembly for movable bolster assembies adapted to ride on bolster track comprising:

housing means adapted to be affixed to a bolster assembly, said housing means having a cylinder portion;

cylinder piston means slidably received within said cylinder portion of said housing means for movement between first and second positions, said cylinder piston means and cylinder portion defining a chamber for receiving hydraulic fluid, said cylinder piston means including wheel mounting means, said wheel mounting means being rotatable relative to said housing to permit a bolster to move in differing directions;

bolster wheel means rotatably affixed to said wheel mounting means of said cylinder piston means for movement into and out of engagement with the bolster track as said piston means is moved between said first and second positions; and, hydraulic fluid line means in communication with said chamber for receiving hydraulic fluid to power said cylinder piston means and wheel means between said first position wherein said wheel means is engaged with the track and said second position wherein said wheel means is disengaged from the track, to raise and lower a bolster.

12. The wheel assembly of claim 11 wherein said wheel means further comprises:

a driven gear means coupled to said wheel means;

first and second drive gear means, said first and second drive gear affixed relative to said housing at differing angular orientations, said driven gear selectively engageable with said first and second drive gear means upon rotation of said wheel mounting means; and power means coupled to said first and second drive gears to power said driven gear and wheel means in differing directions.

13. The wheel assembly of claim 11 further including turning means for rotating said wheel mounting means to change the axial alignment of said wheel means relative to said housing to permit said bolster assembly to move in differing directions.

14. A wheel assembly for movable bolster assemblies adapted to ride on bolster track comprising:

housing means adapted to be affixed to a bolster assembly, said housing means having a cylinder portion;

cylinder piston means slidably received within said cylinder portion of said housing means for movement between first and second positions, said cylinder piston means and cylinder portion defining a chamber for receiving hydraulic fluid, said cylinder piston means including wheel mounting means;

bolster wheel means rotatably affixed to said wheel mounting means of said cylinder piston means for engagement with said bolster track;

hydraulic fluid line means in communication with said chamber for receiving hydraulic fluid to power said cylinder piston means and wheel means between a first position wherein said wheel means is engaged with said track and a second position wherein said wheel means is disengaged from said track, to raise and lower a bolster; and, shaft means coupled to said bolster wheel means for rotation therewith, said shaft means including sliding couplings and a universal joint to allow said shaft means to accommodate differing vertical orientations of said bolster wheel means; and, motor means coupled to said shaft means to power said bolster wheel means to effect movement of a bolster.

15. The wheel assembly of claim 14 further comprising a wheel assembly frame secured to said housing and supporting said motor means and shaft means thereto, and adapted to be affixed to a bolster assembly.

16. A movable bolster for riding on bolster track comprising:

a frame, a plurality of adjustable wheel assemblies affixed to said frame, each of said wheel assemblies including:

a housing attached to said frame, said housing having a cylinder portion open towards one end for positioning proximal to the bolster track;

cylinder piston means slidably received within said cylinder portion of said housing for movement along a generally vertical axis between first and second positions, said cylinder piston means and cylinder portion defining a chamber for receiving hydraulic fluid, said cylinder piston means including wheel mounting means;

bolster wheel means rotatably affixed to said wheel mounting means for movement with said cylinder piston means along said axis into and out of engagement with the bolster track as said piston means is moved between said first and second positions;

hydraulic fluid line means in communication with said chamber for receiving hyraulic fluid to power said cylinder piston means between said first position and said second position wherein said wheel means is engaged with and disengaged from said track, respectively, to raise and lower a bolster.

17. The movable bolster of claim 16 further including spring means coupled to said piston means and housing biasing said cylinder piston cylinder means in one of said positions to facilitate movement of said wheel means.

18. The movable bolster of claim 16 wherein said cylinder portion includes an end wall and a cylindrical wall, said end wall includes an opening and said cylinder piston means further includes a vertically projecting rod extending through and slidably received by said opening in said end wall to provide stability to said cylinder piston means.

19. The movable bolster of claim 18 further including spring means affixed to said rod for engagement with said end wall to bias said cylinder piston means in one of said positions to facilitate movement of said wheel means.

20. The movable bolster of claim 18 wherein said rod further includes an end stop means restricting the travel of said piston means as said piston means travels outward from said cylinder portion.

21. The movable bolster of claim 18 further includes turning means for rotating said wheel mounting means to change the axial alignment of said wheel means relative to said housing to permit said bolster assembly to move in differing directions.

22. The moveable bolster of claim 16 further comprising bolster power means coupled to said wheel means to provide rotational movement to said wheel means to move said bolster.

23. A wheel assembly for movable bolster assemblies adapted to ride on bolster track comprising:

housing means adapted to be affixed to a bolster assembly, said housing means having a cylinder portion;

cylinder piston means slidably received within said cylinder portion of said housing means, said cylinder piston means and cylinder portion defining a chamber for receiving hydraulic fluid, said piston means including wheel mounting means rotatable relative to said housing to permit a bolster to move in differing directions;

bolster wheel means rotatably affixed to said wheel mounting means of said cylinder piston means for engagement with said bolster track;

hydraulic fluid line means in communication with said chamber for receiving hydraulic fluid to power said cylinder piston means and wheel means between a first position wherein said wheel means is disengaged from said track and a second position to raise and lower a bolster;

a driven gear coupled to said wheel means, first and second drive gears;

said first and second drive gears being affixed relative to said housing at differing angular orientations, said driven gear selectively engageable with said first and second drive gears upon rotation of said wheel mounting means, and power means coupled to said first and second drive gears to power said driven gear and wheel means in differing directions.

24. The wheel assembly of claim 23 further including turning means for rotating said wheel mounting means to charge the axial alignment of said wheel means relative to said housing to permit said bolster assembly to move in differing directions.

25. A wheel assembly for movable bolster assemblies adapted to ride on bolster track comprising:

housing adapted to be affixed to a bolster assembly, said housing having a cylinder portion;

cylinder piston means slidably received within said cylinder portion of said housing means, said cylinder piston means and cylinder portion defining a chamber for receiving hydraulic fluid, said cylinder piston means including wheel mounting means rotatable relative to said housing to permit a bolster to move in differing directions;

bolster wheel means rotatably affixed to said wheel mounting means of said cylinder piston means, said bolster wheel means for engagement with said bolster track;

hydraulic fluid line means in communication with said chamber for receiving hydraulic fluid to power said cylinder piston means and wheel means between a first position wherein said wheel means is disengaged from said track and a second position wherein said wheel means is engaged with said track, to raise and lower a bolster, and, first and second power means, said wheel means engageable with said first power means for a selected axial alignment of said wheel means and engageable with said second power means for a differing axial alignment of said bolster wheel.

26. A movable bolster for riding on bolster track comprising:

a frame;

a plurality of adjustable wheel assemblies affixed to said frame, each of said wheel assemblies including:

a housing means attached to said frame, said housing having a cylinder portion;

cylinder piston means slidably received within said cylinder portion of said housing for movement between first and second positions, said cylinder piston means and cylinder portion defining a chamber for receiving hydraulic fluid, said cylinder piston means including wheel mounting means, said wheel mounting means being rotatable relative to said housing to permit a bolster to move in differing directions;

bolster wheel means rotatably affixed to said wheel mounting means for movement with said cylinder piston means into and out of engagement said bolster track as said piston means is moved between said first and second positions;

hydraulic fluid line means in communication with said chamber for receiving hydraulic fluid to power said cylinder piston means between said first position and said second position wherein said wheel means is engaged with and disengaged from said track, respectively, to raise and lower a bolster.

27. A movable bolster for riding on bolster track comprising:

a frame, a plurality of adjustable wheel assemblies affixed to said frame, each of said wheel assemblies including:

a housing attached to said frame, said housing having a cylinder portion;

cylinder piston means slidably received within said cylinder portion of said housing, said cylinder piston means and cylinder portion defining a chamber for receiving hydraulic fluid, said cylinder piston means including wheel mounting means, said wheel mounting means being rotatable relative to said housing to permit a bolster to move in differing directions;

bolster wheel means rotatably affixed to said wheel mounting means and including a driven gear means coupled to said wheel means; first and second drive gear means, said first and second drive gear affixed relative to said housing at differing angular orientations, said driven gear selectively engageable with said first and second drive gear means upon rotation of said wheel mounting means, and power means coupled to said first and second drive gears to power said driven gear and wheel means in differing directions;

hydraulic fluid line means in communication with said chamber for receiving hydraulic fluid to power said cylinder piston means between a first position and a second position wherein said wheel means is engaged with said track, to raise and lower a bolster.

28. A movable bolster for riding on bolster track comprising:

a frame;

a plurality of adjustable wheel assemblies affixed to said frame, each of said wheel assemblies including:

a housing attached to said frame, said housing having a cylinder portion;

cylinder piston means slidably received within said cylinder portion of said housing, said cylinder piston means and cylinder portion defining a chamber for receiving hydraulic fluid, said cylinder piston means including wheel mounting means rotatable relative to said housing to permit a bolster to move in differing directions;

bolster wheel means rotatably affixed to said wheel mounting means;

hydraulic fluid line means in communication with said chamber for receiving hydraulic fluid to power said cylinder piston means between a first position and a second position wherein said wheel means is engaged with said track, to raise and lower a bolster; and, first and second power means coupled to said wheel assemblies, said wheel means engageable with said first power means for a selected axial alignment of said wheel means and engageable with said second power means for a differing axial alignment of said bolster wheel.

* * * * *